US010689858B2

(12) United States Patent
Scherrer et al.

(10) Patent No.: US 10,689,858 B2
(45) Date of Patent: Jun. 23, 2020

(54) MODULAR HOOKING DEVICE FOR A CLOTH FOR A TENSIONED FALSE CEILING

(71) Applicants: Jean-Marc Scherrer, Riedisheim (FR); Mark Pinchot, Solon, OH (US)

(72) Inventors: Jean-Marc Scherrer, Riedisheim (FR); Mark Pinchot, Solon, OH (US)

( * ) Notice: Subject to any disclaimer, the term of this patent is extended or adjusted under 35 U.S.C. 154(b) by 0 days.

(21) Appl. No.: 15/124,151

(22) PCT Filed: Mar. 2, 2015

(86) PCT No.: PCT/FR2015/050503

§ 371 (c)(1),
(2) Date: Sep. 7, 2016

(87) PCT Pub. No.: WO2015/136188

PCT Pub. Date: Sep. 17, 2015

(65) Prior Publication Data

US 2017/0016234 A1 Jan. 19, 2017

(30) Foreign Application Priority Data

Mar. 10, 2014 (FR) ..... 14 51940

(51) Int. Cl.
*G09F 17/00* (2006.01)
*E04B 1/00* (2006.01)
(Continued)

(52) U.S. Cl.
CPC ..... *E04F 13/005* (2013.01); *E04B 9/0414* (2013.01); *E04B 9/30* (2013.01); *E04B 9/303* (2013.01); *E04B 2009/0492* (2013.01)

(58) Field of Classification Search
CPC ..... E04B 9/30; E04B 9/303; E04B 9/0414; E04B 2009/0492; E04F 13/005;
(Continued)

(56) References Cited

U.S. PATENT DOCUMENTS 2,255,581 A * 9/1941 Ewing ..... A47G 5/00 160/392
2,335,361 A * 11/1943 Schiller ..... E06B 9/52 160/395
(Continued)

FOREIGN PATENT DOCUMENTS

DE 202009005753 7/2009

OTHER PUBLICATIONS

International search report for application No. PCT/FR2015/050503 dated May 20, 2015.

*Primary Examiner* — Joshua J Michener
*Assistant Examiner* — James Buckle, Jr.
(74) *Attorney, Agent, or Firm* — Bachman & LaPointe, P.C.

(57) ABSTRACT

A device for attaching at least one cloth for producing a tensioned-cloth false partition, comprising a first profiled member forming a profiled rail comprising at least one reception groove, the reception groove being delimited by at least two lateral walls, and at least one second profiled member able to be fitted removably in the reception groove of the first profiled member, having a cross section in the form of a U or V, one of the arms of the U or V shape comprising at least one deformable longitudinal projection arranged so as to come into abutment against a wall disposed opposite the arm carrying the deformable projection when the second profiled member is in place in the reception groove of the first profiled member.

10 Claims, 1 Drawing Sheet

(51) Int. Cl.
*E04F 13/00* (2006.01)
*E04B 9/30* (2006.01)
*E04B 9/04* (2006.01)

(58) Field of Classification Search
CPC ..... G09F 17/00; G09F 15/0025; Y10T 24/44043; Y10T 24/4406; E06B 3/5821; E06B 3/5828; E06B 3/5835; E06B 9/52; F16B 5/0692; E06L 33/5821; E06L 33/5828; E06L 33/5835; E06L 39/52
USPC ..... 52/222; 38/102.3, 102.4; 40/590, 603; 160/328, 378
See application file for complete search history.

(56) References Cited

U.S. PATENT DOCUMENTS 3,141,221 A * 7/1964 Faulls, Jr. ..... B65D 33/1666 206/1.5
3,220,469 A * 11/1965 Oehmig ..... E06B 9/52 160/380
4,107,826 A * 8/1978 Tysdal ..... F16B 5/0692 160/395
4,153,981 A * 5/1979 Stuppy ..... A01G 9/1407 160/395
4,194,312 A * 3/1980 Connors ..... D06C 3/08 101/127.1
4,409,758 A * 10/1983 Dickerson ..... E06B 3/28 160/231.2
4,441,290 A * 4/1984 Abell ..... E06B 3/285 52/202
4,562,634 A * 1/1986 Watts ..... B44C 7/022 160/392
4,571,897 A * 2/1986 Kerr ..... E04D 3/28 52/13
RE32,509 E * 9/1987 Werner ..... E06B 3/28 52/202
4,788,806 A * 12/1988 Sease ..... B44C 7/022 160/395
4,920,714 A * 5/1990 Sease ..... B44C 7/022 160/392
4,986,332 A * 1/1991 Lanuza ..... B44C 7/022 160/327
5,245,773 A * 9/1993 Snyder ..... G09F 15/0025 38/102.91
5,259,323 A * 11/1993 Koch ..... B60D 5/003 105/20
5,398,388 A * 3/1995 Coleman ..... G09F 15/0025 24/462
5,467,546 A * 11/1995 Kovalak, Jr. ..... G09F 15/0025 160/378
5,517,779 A * 5/1996 Coleman ..... G09F 13/0413 160/328
5,572,821 A * 11/1996 Coleman ..... G09F 15/0025 160/328
5,647,155 A * 7/1997 Hillstrom ..... G09F 15/0025 160/371
5,904,200 A * 5/1999 Agen ..... E06B 9/52 160/371
6,209,245 B1 * 4/2001 Wittenberg ..... G09F 15/0025 160/378
6,802,357 B2 * 10/2004 Taylor ..... F16B 5/0028 160/371
6,892,787 B1 * 5/2005 Stretch ..... E06B 9/52 160/371
7,165,296 B2 * 1/2007 Coleman ..... F16B 5/0692 24/462
7,537,043 B2 * 5/2009 Veivers ..... F16B 5/0028 160/371
7,934,350 B2 * 5/2011 Koutsoukos ..... E06B 9/52 160/378
8,347,939 B2 * 1/2013 Brabeck ..... E06B 9/52 160/380
9,284,770 B2 * 3/2016 Sprague ..... E06B 3/308
9,512,612 B2 * 12/2016 Gower ..... E04B 1/40
2003/0005559 A1 * 1/2003 Verret ..... G09F 1/12 24/462
2006/0202506 A1 * 9/2006 Brabeck ..... B60P 3/36 296/146.1
2012/0073771 A1 * 3/2012 Dickison ..... E06B 9/52 160/395
2014/0130993 A1 * 5/2014 Zwar ..... E06B 5/00 160/371
2015/0233177 A1 * 8/2015 Marchand ..... E06B 3/285 160/378
2019/0024451 A1 * 1/2019 Seuberling ..... E06B 9/52

* cited by examiner

MODULAR HOOKING DEVICE FOR A CLOTH FOR A TENSIONED FALSE CEILING

BACKGROUND

The invention relates to the technical field of tensioned false ceilings and false walls.

The invention relates more particularly to a device for attaching at least one cloth for producing a tensioned-cloth false partition.

Conventionally, false partitions are produced from profiled members, normally referred to as rails, able to be fixed to a wall or ceiling of a room, on which flexible cloth is attached.

To enable them to be attached to the rails, the cloth has peripheral edges provided with attachment means conventionally in the form of a harpoon. The associated rails for their part have a shape suitable for holding the attachment means of the cloth. In particular, they comprise a U-shaped groove comprising an attachment shoulder on which the attachment means is intended to bear. The cloth provided with attachment means are in general PVC cloth.

Considering that, in the context of some implementations or of the material from which the cloth is produced, attachment by means of attachment means such as a harpoon is not suitable, rails are proposed in the form of flexible clips, said clips being arranged to hold the cloth by gripping between two flanges or wedging between a flange and a wall. The cloths concerned then have no attachment means. Such rails are frequently used with textile cloths.

The drawback of the rails described above is that they are configured to suit only one type of cloth. Type of cloth means cloths provided with attachment means and cloths with no attachment means. Thus the choice of a cloth depends on the type of rail used and vice versa, which has several drawbacks. In particular, when a cloth of an existing false partition is replaced, the choice of the cloth will depend on the rails initially used. Likewise, the rails, when they are configured to receive several cloths, do not make it possible to offer a mixture in the cloths used.

The invention aims to remedy these problems by proposing a modular attachment device for attaching either a cloth provided with attachment means or a cloth with no attachment means.

The invention aims to propose also an attachment device making it possible to adapt, simply and rapidly, temporarily or not, an existing rail profile configured for attaching a cloth with no attachment means.

The invention aims also to propose an attachment device for providing the attachment of a plurality of cloths, whether or not they are provided with attachment means.

SUMMARY

To this end, and according to a first aspect, the invention proposes a device for attaching at least one cloth for producing a tensioned-cloth false partition comprising a first profiled member forming a profiled rail comprising at least one reception groove delimited by at least two lateral walls, and at least one second profiled member, able to be fitted removably in the reception groove of the first profiled member and having a cross section in the form of a U or V, one of the arms of the U or V shape comprising at least one deformable longitudinal projection arranged so as to come into abutment against a wall disposed opposite the arm carrying the deformable projection when the second profiled member is in place in the reception groove of the first profiled member so as to hold the cloth by clamping against the wall portion of the reception groove.

Thus, when an existing false ceiling has been produced by means of a cloth equipped with attachment means and rails suitable for holding the means for attaching the cloth (rails corresponding to the aforementioned first profiled member), it is possible to adapt said rails by inserting a profiled member of the same type as the second profiled member so as to enable a cloth with no attachment means to be held. This device therefore makes it possible to make certain existing profiled members usable in tensioned ceilings made from either PVC or Artolis® textile cloth.

Furthermore, the shoulder that makes it possible to hold the second profiled member in the first also constitutes the means for holding the attachment means (of the harpoon type) equipping the peripheral edge of the cloth. Because of this, use of the second profiled member requires no modification to the groove or even providing in the groove an additional means for attaching the second profiled member.

Advantageously, the projection extends at least as far as a plane passing through the external face of the other arm of the U or V shape. When the peripheral edge of the cloth is placed in the second profiled member, the cloth is held by clamping between the projection and the internal face of the reception groove.

According to a particular embodiment, the other arm of the U or V shape, opposite to the arm carrying the deformable projection, is sized so as to have an end coming into abutment on a longitudinal shoulder provided on one of the lateral walls of the reception groove when the second profiled member is in place in the reception groove of the first profiled member. This has the advantage of preventing any movement of the second profiled member when the latter is placed in the reception groove of the first profiled member. In this embodiment, the projection comes into abutment against the wall of the reception groove carrying the shoulder. Moreover, and advantageously, the shoulder enabling the second profiled member to be held in the first also constitutes the means for holding the attachment means (of the harpoon type) equipping the peripheral edge of the cloth.

Advantageously, the deformable projection extends beyond a plane corresponding to the external face of the arm opposite to the arm carrying the deformable projection. This thus makes it possible to improve the wedging of the cloth between the deformable projection and the relevant lateral wall of the reception groove.

Advantageously, the deformable projection has a flange profile.

Advantageously, the deformable projection comprises two lips arranged one with respect to the other in order to define a projection having a V-shaped cross section.

Advantageously, one of the lips extends perpendicular to a plane corresponding to the arm comprising the deformable projection.

Advantageously, the second profiled member is arranged so as to be inserted fully in the reception groove. This thus makes it possible not to impact the visual appearance of the profiled rail.

Advantageously, the second profiled member is produced from rigid or semi-rigid PVC. This thus facilitates the insertion of the second profiled member in the first profiled member as well as removal thereof by means of a suitable instrument while offering sufficient strength and rigidity to remain "embedded" in the first profiled member when the cloth is attached in the second profiled member and then subjected to a tension for the purpose of producing the tensioned ceiling.

Advantageously, the deformable projection is produced from semi-rigid or flexible polymer.

The invention also relates to an additional profiled member intended to be mounted removably in a reception groove of a profiled member constituting a profiled rail, said groove being delimited by at least two lateral walls, at least one of the lateral walls advantageously being able to hold a peripheral edge of a cloth equipped with a harpoon, said additional profiled member having a cross section in the form of a U or V sized so as to be fitted in the reception groove of the profiled rail in which it is intended to be inserted, one of the arms of the U or V shape comprising at least one deformable longitudinal projection arranged so as to come into abutment against a lateral wall disposed opposite the arm carrying the deformable projection when the additional profiled member is in place in the reception groove of the profiled rail.

The advantage of such a profiled member is being able to be used with existing profiled rails that can be used in tensioned ceilings made from PVC or Artolis® textile cloth.

The additional profiled member reproduces all the features of the second profiled member mentioned above.

Thus, according to a particular embodiment, the other arm of the U or V shape has a width less than that of the arm carrying the deformable projection, the width being determined so that, when the additional profiled member is in place in the reception groove of the profiled rail, it has one end in abutment on a shoulder provided on one of the lateral walls of the reception groove of the profiled rail. Advantageously, the deformable projection has a flange profile. Another configuration may also be provided in which the deformable projection of the second profiled member advantageously comprises two lips arranged one with respect to the other so as to define a projection having a cross section in a V. Advantageously, one of the lips extends perpendicular to a plane corresponding to the arm comprising the deformable projection. According to an advantageous configuration, the deformable projection is provided at the free end of the arm. Advantageously, the other arm, opposite to the arm carrying the deformable projection, is sized so as to come into abutment on a shoulder provided on the lateral wall of the reception groove disposed opposite the arm carrying the deformable projection when the second profiled member is in place in the reception groove of the first profiled member. Advantageously, the deformable projection extends beyond a plane corresponding to the external face of the arm opposite to the arm carrying the deformable projection. This thus makes it possible to improve the wedging of the cloth between the deformable projection and the relevant lateral wall of the reception groove. Advantageously, the second profiled member is produced from rigid or semi-rigid PVC. Advantageously, the deformable projection is produced from semi-rigid or flexible polymer.

BRIEF DESCRIPTION OF THE DRAWINGS

Other objects and advantages of the invention will emerge during the following description, given with reference to the accompanying drawings, in which.

DETAILED DESCRIPTION

Figure 1:
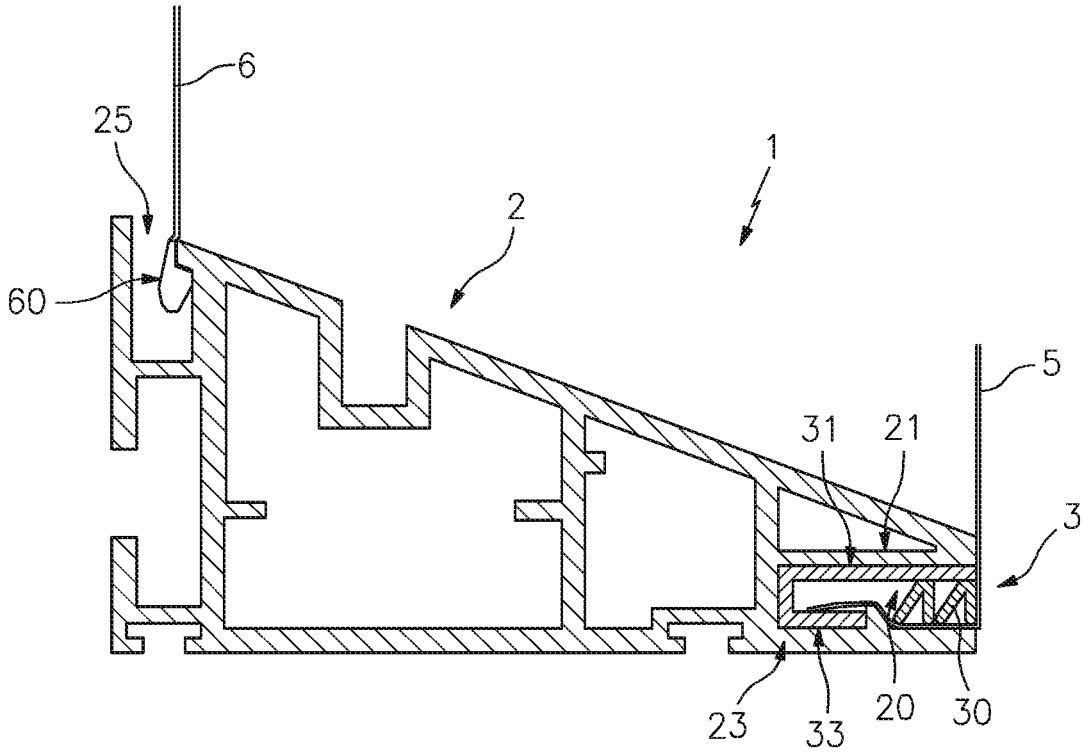
FIG. 1 depicts a schematic view in cross section of a device for attaching a textile cloth according to the invention.
Figure 2:
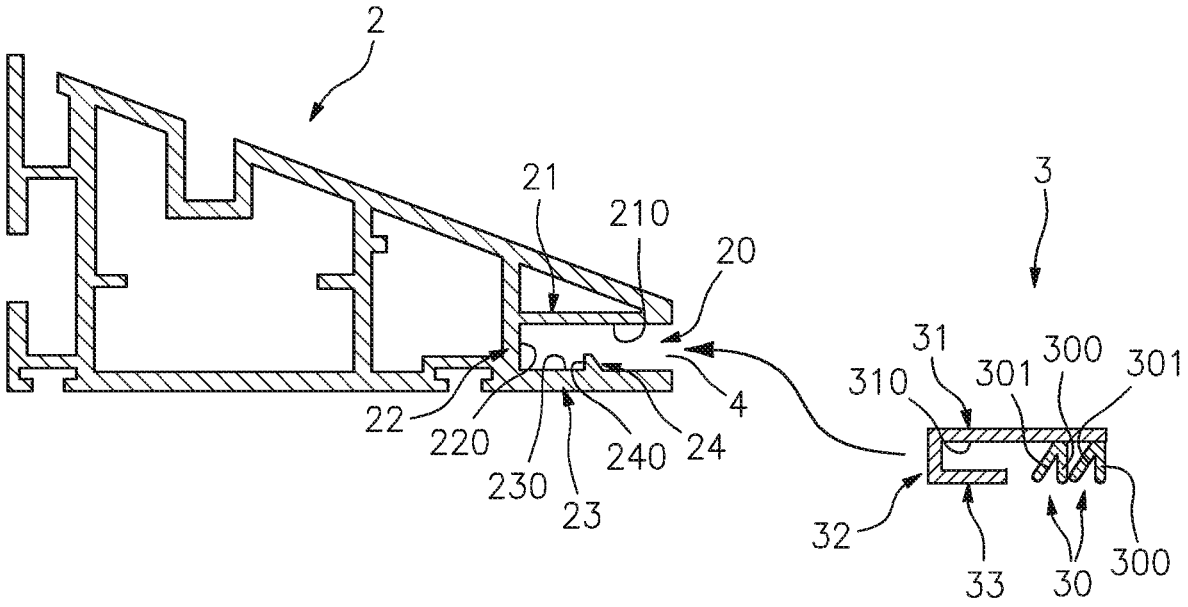
FIG. 2 depicts a view of the attachment device of FIG. 1 before the additional profiled member is placed in the profiled rail.

In relation to FIGS. 1 and 2, a device 1 for attaching a cloth for producing a tensioned-cloth false ceiling is described, comprising a first profiled member 2 and a second profiled member 3 able to be integrated in the first profiled member 2. The first profiled member 2 and the second profiled member 3 are hereinafter referred respectively as the profiled rail or main profiled member 2 and additional profiled member 3.

In the embodiment illustrated, the main profiled member 2, preferably made from aluminium, consists of a profiled rail in the form of a right-angled triangle, intended to be fixed to a support for the purpose of attaching a cloth by its peripheral edges provided, to do this, with an attachment means in the form of a harpoon. Such a profiled member is known and the general form of such a profiled member is described in the applications FR 2952087 and FR 2970013 in the name of the applicant. Any other form of main profiled member may of course be provided without departing from the scope of the invention. Such a profiled member is intended in particular for attaching a PVC cloth.

Like any profiled rail used for installing a cloth comprising attachment means, the profiled member 2 comprises a reception groove 20 intended to receive the attachment means. In the embodiment illustrated, the reception groove 20 has a U-shaped cross section and is delimited by two lateral walls 21, 23 and a bottom wall 22. The ends of the U-shaped lateral walls, opposite to the bottom wall 22, define an opening 4 for passage of the means for attaching the cloth in the reception groove 20. In order to attach the means for attaching the cloth, the internal face of one of the lateral walls comprises a longitudinal attachment shoulder 24. In the example illustrated, the attachment shoulder 24 is provided on the internal face 230 of the external lateral wall 23. External wall means the wall furthest away from the space delimited by the ceiling and the cloth when the latter is in place (awning). Moreover, "internal face" designates a face disposed on the groove side. Conversely, "external face" designates a face disposed on the side opposite to the groove.

The additional profiled member 3, advantageously made from PVC, has a form substantially complementary to that of the reception groove 20 of the main profiled member 2. More particularly, the additional profiled member 3 is, in the embodiment illustrated, in the form of an elongate blade, preferably with the same length as that of the main profiled member 2, with a U-shaped cross section. One of the arms 31 of the blade is sized so as extend over the entire width of the lateral wall 21 opposite to the lateral wall 23 carrying the attachment shoulder 24. The other arm 33 for its part is sized so as to have a width less than or equal to the width between the internal face 220 of the bottom wall 22 and the attachment surface 240 of the attachment shoulder 24. Width of the arms means the distance separating the bottom wall 32 of the U shape and the free end of said arms. Likewise, width of the lateral walls means the distance separating the bottom wall 22 and the end of said lateral walls opposite to the bottom wall 22. The attachment surface 240 is sized so as to hold in place the additional profiled member 3 in the reception groove 20 of the main profiled member 2. It will thus preferably extend over a height at least equal to the thickness of the holding arm 33 in order to provide sufficient and satisfactory holding of the additional profiled member 3 in the main profiled member 2. The surface 240 is also configured so as to prevent any sliding of the holding arm when the additional profiled member 3 is in place in the main profiled member 2 and thus prevent any unwanted withdrawal of the additional profiled member 3 from the main profiled member 2. Advantageously, the surface 240 is flat.

In the example illustrated, the arm 33 has a width equal to the distance between the attachment surface 240 of the attachment shoulder 24 and the internal face 220 of the bottom wall 22. Thus, when the additional profiled member 3 is placed in the reception groove 20, it is snapped into the latter. Any movement between the additional profiled member 3 and the main profiled member 2 is then prevented, the additional profiled member 3 being held in the main profiled member 2 by abutment on the shoulder 24. The arm 33 thus forms a holding arm.

The insertion of the additional profiled member 3 in the reception groove 20 is made possible because of its U shape. The additional profiled member 3 is positioned by elastic snapping into the groove 20 of the main profiled member 2. When the additional profiled member 3 is inserted in the reception groove 20, the holding arm 33 undergoes a slight bending in the direction of the arm carrying the projections 30 because of the presence of the shoulder, in order to resume its initial position once the end of said holding arm has passed the shoulder 24. The same applies with regard to its removal, carried out by means of a suitable tool.

The arm 31 of the additional profiled member 3, opposite to the holding arm 33, is provided, on its internal face 310, with semi-rigid or flexible longitudinal projections 30. Support arm 31 will be spoken of hereinafter.

The projections 30 are arranged on the arm 31 and sized so as to come into abutment against the internal face 230 of the lateral wall 23 of the reception groove 20 carrying the attachment shoulder 24 when the additional profiled member 3 is in place in the reception groove 20. The presence of these projections 30 thus makes it possible to hold a cloth 5 with no attachment means (for example a textile cloth) by simple clamping of the projections 30 against the wall portion of the reception groove 20 situated between the attachment shoulder 24 and the opening 4 of the reception groove 20.

Advantageously, each projection 30 comprises two lips 300, 301 with a cross section in a V. In the embodiment illustrated, the lip 300 of each projection closest to the free end of the support arm 31 extends perpendicular to a plane corresponding to the internal face of said arm (the arm carrying the longitudinal projection). As for the other lip 301, this extends at an angle of approximately 45 degrees with respect to the perpendicular lip.

In order to prevent the cloth 5 rubbing against the free end of the support arm 31 when it is tensioned between two main profiled members, a projection 30 is provided at the free end of the support arm 31 so as to close off the opening 4 of the reception groove 20 when the additional profiled member 3 is in place in the main profiled member 2.

Advantageously, the projections 30 are produced from semi-rigid or flexible polymer. This also makes it possible to grip the cloth 5 against one of the lateral walls of the reception groove 20 so as to ensure holding thereof at its peripheral end while preventing damage to the groove.

In the embodiment illustrated, the support arm 31 comprises two projections 30. It is of course obvious that it is possible to provide other embodiments in which the arm comprises a single projection or more than two projections 30, according to the degree of clamping required. In order to further increase the degree of clamping of the cloth 5 against the lateral wall 23 of the reception groove 20, provision can also be made for the projections 30 to extend beyond a plane corresponding to the external face of the holding arm 33. Moreover, the form of the projections is not limited to the one illustrated in FIGS. 1 and 2, any other form being able to be envisaged without departing from the scope of the invention. Likewise, the number of projections can vary according to the dimensions of the additional profiled member and the degree of clamping required.

In the previously described embodiment, the reception groove 20 has a cross section in a U. It is of course obvious that the invention is not limited to this type of groove, and that the invention can be implemented with a main profiled section 2 having a groove in the form of a V or a trough form provided with any bottom wall, the additional profiled member 3 having in any event a cross section with a complementary form.

From the above description, it will be understood that the additional profiled member 3 enables a cloth with no attachment means to be attached to a main profiled member initially intended for attaching cloths provided with attachment means. Thus the attachment device enables cloths of any type to be used.

The attachment device also makes it possible to combine mixed frames. This is because, when the main profiled member comprises a plurality of reception grooves suitable for holding an attachment means of a cloth, this method can allow the attachment of a plurality of cloths, some being equipped with attachment means, the others having none. In the latter case, an additional profiled member will be integrated in the corresponding reception groove. FIG. 1 illustrates the use of such a frame, the cloth 5 with no attachment means being fixed in the reception groove 20 by clamping of projections against the lateral wall 23 of the groove while the cloth 6 provided with attachment means 60 is fixed conventionally in the groove 25.

In the previously described embodiment, the attachment device 1 comprises only one additional profiled member. It is course obvious that provision can be made to integrate a plurality of additional profiled members in the main profiled member, the form and dimensions of said additional profiled members being adapted to the form and dimensions of the reception groove for which they are intended.

The invention is described above by way of example. It will be understood that a person skilled in the art is in a position to produce different variant embodiments of the invention without departing from the scope of the invention.

The invention claimed is:

1. A device for attaching at least one cloth for producing a tensioned-cloth false partition, comprising: a first profiled member forming a profiled rail comprising at least one reception groove having a cross section in the form of a U, the at least one reception groove being delimited by first and second lateral walls parallel to each other, and at least one second profiled member being configured as removable from the reception groove of the first profiled member, said at least one second profiled member having a form substantially complementary to that of the at least one reception groove of the first profiled member and being configured to be fitted fully within the at least one reception groove of the first profiled member, said at least one second profiled member comprising first and second arms parallel to each other, said first and second arms being respectively placed over the first and second lateral walls when the second profiled member is in place in the at least one reception groove of the first profiled member; said second arm having an inner surface facing the first arm comprising at least one deformable longitudinal projection arranged so as to come into abutment against the first lateral wall of said first profiled member disposed opposite the second arm and on which the first arm of the second profiled member is placed when the second profiled member is in place in the at least one reception groove of the first profiled member.

2. The attachment device according to claim 1, wherein the at least one deformable longitudinal projection extends at least as far as a plane passing through an external face of the second arm.

3. The attachment device according to claim 2, wherein the second arm, opposite to the first arm carrying the at least one deformable longitudinal projection, is sized so as to have one end coming into abutment on a longitudinal shoulder provided on one of the lateral walls of the at least one reception groove when the second profiled member is in place in the at least one reception groove.

4. The attachment device according to claim 1, wherein the at least one deformable projection has a flange profile.

5. The attachment device according to claim 1, wherein the at least one deformable projection comprises two lips arranged one with respect to the other so as to define a projection with a cross section in a V.

6. The attachment device according to claim 5, wherein the second profiled member is produced from rigid or semi-rigid PVC.

7. The attachment device according to claim 6, wherein the at least one deformable projection is produced from at least one of a semi-rigid polymer and a flexible polymer.

8. The attachment device according to claim 1, wherein the first and/or second lateral wall is arranged to being able to hold a peripheral edge of a cloth equipped with a means for attaching.

9. The attachment device according to claim 3, wherein the first arm has a width less than that of the second arm carrying the deformable projection, the width being determined so that, when the second profiled member is in place in the reception groove of the first profiled member rail, said end of the first arm comes into abutment on said longitudinal shoulder provided on the first or the second lateral wall of the at least one reception groove.

10. A device for attaching at least one cloth for producing a tensioned-cloth false partition, comprising:

a first profiled member forming a profiled rail comprising at least one reception groove, the reception groove being delimited by at least two lateral walls, and at least one second profiled member being configured as removable from the reception groove of the first profiled member and being configured to be fitted fully within the reception groove of the first profiled member, said at least one second profiled member having a cross section in the form of a J, a support arm opposite the holding arm of the J shape having an inner surface comprising at least one deformable longitudinal projection arranged so as to come into abutment against the lateral wall of said first profiled member disposed opposite the arm carrying the deformable projection when the second profiled member is in place in the reception groove of the first profiled member, wherein the deformable projection comprises two lips arranged one with respect to the other so as to define a projection with a cross section in a V.

* * * * *